United States Patent [19]

Bair et al.

[11] Patent Number: 5,049,430

[45] Date of Patent: Sep. 17, 1991

[54] COPOLYESTER FIBERS SUITABLE FOR USE IN CARPETS

[75] Inventors: Thomas I. Bair, Wilmington; Henry Kobsa, Greenville, both of Del.

[73] Assignee: E. I. Du Pont de Nemours and Company, Wilmington, Del.

[21] Appl. No.: 321,388

[22] Filed: Mar. 10, 1989

[51] Int. Cl.[5] ..... D04H 11/00; D02G 3/00; C08G 63/66

[52] U.S. Cl. ..... 428/97; 428/364; 528/295; 528/301; 528/308.1

[58] Field of Search ..... 528/301, 308.1, 295; 428/97, 364

[56] References Cited

U.S. PATENT DOCUMENTS

| | | | |
|---|---|---|---|
| 2,744,087 | 5/1956 | Snyder | 260/75 |
| 3,013,914 | 12/1961 | Willard | 154/43 |
| 3,152,380 | 10/1964 | Martin | 28/72 |
| 3,701,755 | 10/1972 | Sumoto et al. | 260/75 R |
| 3,887,523 | 6/1975 | Yau et al. | 528/173 |
| 4,377,682 | 3/1983 | Ohguchi et al. | 528/301 |
| 4,526,738 | 7/1985 | Miyoshi et al. | 264/176 |

*Primary Examiner*—Jenna Davis
*Assistant Examiner*—Terrel Morris

[57] ABSTRACT

Copolyester fibers susceptible of enhanced dyeability on continuous dye equipment and which have improved recovery from compression are prepared from a poly(alkylene terephthalate) such as poly(ethylene terephthalate) containing 9 to 17 weight percent of a poly(-tetramethylene ether) glycol having a molecular weight of 500 to 1500.

10 Claims, No Drawings

COPOLYESTER FIBERS SUITABLE FOR USE IN CARPETS

FIELD OF THE INVENTION

This invention relates to copolyester fibers susceptible of enhanced dyeability on continuous dye equipment, i.e. so-called dye ranges, and which have improved recovery from compression.

BACKGROUND OF THE INVENTION

Polyamide fiber has become the most popular synthetic material for carpets because of its outstanding combination of wear resistance, bulk, recovery from compression and easy dyeability. Nevertheless polyester fiber has captured a portion of the carpet market because of its low cost and resistance to staining from accidental spills of foods or beverages containing natural or artificial acid dyes. However, polyester carpet fibers tend, by comparison to nylon fibers, to have a slow uptake of disperse dyes and this to a large extent prevents polyester carpets from being dyed on continuous dye ranges where the dyeing cycle is relatively short such as a few mintues. In addition, the polyester carpet fibers are regarded as having poorer recovery from compression than do nylon fibers. The use of carriers had been somewhat successful in increasing the dye rates of polyester fibers, but this has proved in many instances today to be no longer ecologically acceptable for carpet mills. When attempts have been made to increase the rate of dye uptake of a fiber by the inclusion of a comonomeric constituent, e.g. glutaric acid when producing a poly(alkylene terephthalate) such as poly(ethylene terephthalate) (abbreviation 2GT), the already unsatisfactory recovery from compression of the fiber has become still worse. Furthermore, the amount of such a comonomeric constituent needed to give adequate fiber range dyeability has tended to depress the melting point to such a large extent that the fiber becomes difficult or impossible to spin on spinning machines which are directly coupled to continuous polymerization lines. Finally, such an amount of comonomeric constituent has also been found to depress the glass transition temperature of the fiber to such an extent that permanent pile distortion may occur when rolls of carpets are shipped or stored in non air-conditioned vehicles or storage areas during summer months. A polyester fiber having a faster dye uptake and better recovery from compression would be greatly desired, especially if this could be accomplished without compromising other important fiber properties such as melting point.

Accordingly, it is an object of the invention to provide an improved polyester fiber which is suitable for use as a carpet fiber by virtue of enhanced dyeability on continuous dye ranges and which has improved recovery from compression.

SUMMARY OF THE INVENTION

In accordance with the invention there is provided a copolyester fiber susceptible of enhanced dyeability on continuous dye ranges and having improved recovery from compression, both as compared to the corresponding poly(alkylene terephthalate) homopolyester fibers. The copolyester fiber of the invention consists essentially of recurring units derived from terephthalic acid as the acid component and, as the glycol component, a mixture of at least one lower alkylene glycol and a poly(tetramethylene ether) glycol (abbreviation PO4G) having a molecular weight of 500 to 1500. The amount of the PO4G should be such that the fiber contains 9 to 17 weight percent of comonomeric units derived therefrom.

The copolyester fiber of this invention is advantageously 2GT containing 9 to 17 weight percent, preferably 12 to 16 weight percent, of comonomeric units derived from PO4G having a molecular weight of 500 to 1500, preferably 650 to 1500.

DETAILED DESCRIPTION OF PREFERRED EMBODIMENTS

The above-described fibers may be prepared from copolyesters obtained by conventional polycondensation techniques using, as the glycol component, a combination of one or more lower alkylene glycols such as ethylene glycol with PO4G of molecular weight 500 to 1500, and using terephthalic acid as the acid component. In lieu of terephthalic acid per se, there may be used ester forming derivatives such as the dimethyl ester of the acid. While ethylene glycol is the preferred lower alkylene glycol, other glycols including those of 3 or 4 carbons, e.g. trimethylene glycol and butylene glycol, may be used to replace part or all of the ethylene glycol. The term "consisting essentially" is not intended to exclude the presence of still other comonomeric constituents such as 5-sodium sulfoisophthalic acid which have little or no adverse effect on the dyeability and recovery compression properties of the fibers.

In the Examples which follow, the copolyesters are made by a procedure in which the various monomeric components are charged simultaneously to a polymerization vessel and subjected to polycondensation conditions to produce a linear polyester in which the various units are randomly distributed along the molecular chain.

The copolyesters may then be converted to fibers by conventional melt spinning techniques. The filaments may then be drawn or oriented by the usual procedures. Deniers of 1 to 20 dpf are most common. Fibers normally will also be crimped or otherwise bulked and used as such in continuous filament form or cut to staple of a desired length. Carpets may be formed in the usual way using the copolyester fibers to produce the pile.

Among the various known poly(alkylene ether) glycols, PO4G appears to be unique in its ability to confer enhanced dyeability without appreciably sacrificing dye lightfastness and while actually improving recovery from compression, as measured by the Busse' method to be described further hereafter. By including 9 to 17 percent of a PO4G of MW 500 to 1500, it becomes readily possible to achieve a polyester fiber which is capable of being dyed on a continuous basis at up to 212° F. in standard commercial facilities without the need for carriers or pressurized equipment. If less than 9 percent of the PO4G is used, the dye rate is generally inadequate to achieve dyeability in practical periods of time in such facilities. If a greater amount of the PO4G is used, there is a deleterious effect upon other fiber properties such as tenacity and modulus. Indeed the fibers can become elastomeric, which is not desired for a carpet fiber. If the molecular weight of the PO4G is much below 500, the melting point of the fiber and its glass transition temperature are unduly reduced in comparison with that of the corresponding poly(alkylene terephthalate) homopolyester fiber. With a PO4G having a molecular weight much above 1500, this constituent tends to become a separate phase during the polymerization and this can lead to undesired inhomogenetities in the fibers and to an inadequate dyeability.

It will be understood that the relatively small weight percentages of units from the PO4G in the fibers of the invention are even smaller percentages on a mol basis. Hence the polymer melting points and glass transition temperatures will usually be lowered only a few degrees, not enough to seriously affect fiber physical properties but often enough to make spinning easier.

The poly(ethylene ether) glycols, otherwise known as P02G or polyethylene oxides, are known to be useful to improve the dyeability of polyesters, e.g. as described in Snyder U.S. Pat. No. 2,744,087. However, not only do the P02G materials fail to provide fibers of improved recovery from compression, the fibers also suffer from considerably diminished lightfastness. Indeed it is generally not practical to copolymerize more than 10% by weight of such glycols in a 2G-T polymer because of the severe loss which occurs in physical properties.

As used herein, the term "enhanced dyeability on continuous dye ranges" refers to the ability of a copolyester fiber of the invention to be dyed with disperse dyes in the absence of a carrier at temperatures up to the boil, 212° F., i.e. without the use of superatmospheric pressures, and at a rate that is faster than the corresponding homopolyester fiber would be dyed under similar conditions. For example, the copolyester fiber of Example 1 containing 14.3% of PO4G of MW 650 (abbreviation 2G/PO4G-T) dyes much more readily than a homopolyester 2G-T control fiber under the same conditions.

The dye rate test employed herein is performed as follows:

A dye bath of water with 0.5% chelating agent (Versene 100), 1.0% sodium hydrocarbon sulfate leveling agent (Avitone F), 2.0% low foam dyeing assistant (Merpol LFH) and 0.05% Intrasil Red FTS (Colour Index Disperse Red 177) disperse dye is prepared and adjusted to a pH of 5.0 with acetic acid in an Ahiba Tube Dyer. The temperature is adjusted to 100 degrees F. Skeins of yarn which have been scoured in hot water with detergent to remove yarn finishes are mounted on sample racks in the dyer and are caused to move in two directions in the dye bath. The amount of dye is 2% of the fiber weight. The temperature is then raised 3 degrees per minute up to 160° F and then 2 degrees per minute up to 212° F. After 15 minutes at the boil, a 1 cc sample of the dye bath is removed, diluted with 10 cc ethanol to dissolve any suspended material and its absorbance measured with a spectrophotometer to determine how much dye has been removed from the bath. This is a measure of the ability of the yarn skeins to absorb dye in an amount of time considered to be necessary for continuous range dyeing on a commercial scale.

As used herein, recovery from compression is measured by the Busse' method and refers to the ability of a copolyester fiber of the invention to recover more fully from the effects of an applied high pressure compression than does a corresponding homopolyester fiber when treated similarly. The test is performed on staple lengths of yarn and is intended to simulate compression conditions occurring in a carpet during use when, for example, furniture is placed on a carpet. The test measures the percent of original height staple length fiber recover in 24 hours after compression under various loads.

Details of the Busse' method are described in U.S. Pat. No. 3,152,380, column 3, lines 35–70, the disclosure of which is incorporated by reference.

The percent of PO4G in fibers herein is measured by NMR analysis.

The invention will be illustrated by the following examples, with parts and percentages therein and elsewhere in this specification being by weight unless otherwise indicated.

EXAMPLE 1

A copolyester of 2G/PO4G-T is prepared containing 14.3% Teracol 650, a PO4G having a molecular weight of about 650 and which is available from E. I. du Pont de Nemours & Company, Inc.

The polymer is prepared in the usual way by charging to the polymerization vessel 150 parts of dimethyl terephthalate, 98.4 parts of ethylene glycol, and 30 parts of Teracol 650, along with small amounts of antimony oxide and manganese acetate as catalysts. Heat is applied to effect transesterification as methanol is distilled off. Phosphoric acid is then added to deactivate the manganese and polymerization is carried out at 275° C. while distilling off 2G to yield a copolyester having a relative viscosity of about 23.

The copolyester is spun in the conventional manner at about 266° C. from a spinneret containing a series of trilobal orifices to produce filaments having a dpf of 39 and a modification ratio of 1.65. The filaments are drawn 4X, crimped in a stuffer box crimper, and relaxed to yield filaments each of about 12–13 denier. The filaments are then cut to 6 inch staple length. The staple fibers are found to contain 14.3% of the PO4G.

The staple fibers are tested by the Busse' method against 2G-T homopolyester control fibers produced in an otherwise similar manner except that they are spun at 294° C. It is seen in Table I that recovery from compression at all loads is more than twice that of the control. When subjected to the dye rate test, the fiber of the copolyester absorbs 94% of the dye in 15 minutes at the boil whereas the 2G-T control fiber absorbs only 13%. The dye lightfastness of the copolyester fibers and the control are essentially the same.

The melting point of the copolyester fiber is 243° C., only 10° C. lower than that of the control fibers of the homopolymer. By comparison, a commercial carpet fiber based on a copolyester of ethylene glycol terephthalate and containing 9% of units derived from glutaric acid has a melting point some 18° C. below that of 2G-T. Moreover, the dyeability of the glutarate-based copolyester is much inferior to that of the PO4G-based copolyester.

EXAMPLE 2

A copolyester of 2G/PO4G-T is prepared containing 14.7% of a PO4G having molecular weight of about 1,000. The preparation of the polymer and the processing of it into carpet staple is substantially as described in Example 1 except for being spun at 260° C. The copolyester fibers have a melting point of 246° C. versus the same control fibers described in Example 1. The recovery from compression by the Busse, method is comparable to the fiber of Example 1, but the higher melting point permits spinning at a temperature more compatible with those that at which continuous polymerization lines are generally operated. By the dye rate test, the copolyester fibers absorb 95% of the dye in 15 minutes at the boil whereas the 2G-T control absorbs only 13%.

Again, the dye lightfastness is essentially the same as the control fibers.

TABLE I

| Recovery from Compression (Busse' Method) Load | Control (2GT) | Example 1 (14.3% PO4G of 650 MW) | Example 2 (14.7% PO4G of 1000 MW) |
|---|---|---|---|
| 10,000 psi | 23% | 48% | 43% |
| 30,000 psi | 12% | 40% | 33% |
| 100,000 psi | 25% | 63% | 66% |

What is claimed is:

1. A copolyester fiber consisting essentially of recurring units derived from terephthalic acid as the acid component and, as the glycol component, a mixture of at least one lower alkylene glycol and a poly(tetramethylene ether) glycol having a molecular weight of 500 to 1500, the amount of the poly(tetramethylene ether) glycol being such that the fiber contains 9 to 17 weight percent of units derived from the poly(tetramethylene ether) glycol.

2. The fiber of claim 1 where the lower alkylene glycol is ethylene glycol.

3. The fiber of claim 1 or claim 2 where the weight percentage of poly(tetramethylene ether) glycol in the fiber is about 12–16 percent.

4. A copolyester fiber susceptible of enhanced dyeability on continuous dye ranges and having improved recovery from compression, both as compared to the corresponding poly(alkylene terephthalate) homopolyester fiber, said copolyester fiber consisting essentially of recurring units derived from terephthalic acid as the acid component and, as the glycol component, a mixture of a lower alkylene glycol and of a poly(tetramethylene ether) glycol having a molecular weight of 500 to 1500, the amount of the poly(tetramethylene ether) glycol being such that the fiber contains 9 to 17 weight percent of units derived from the poly(tetramethylene ether) glycol.

5. The fiber of claim 4 where the lower alkylene glycol is ethylene glycol.

6. The fiber of claim 4 where the weight percentage of poly(tetramethylene ether) glycol in the fiber is about 12–16 percent.

7. A carpet having pile fibers, the pile fibers of which are copolyester fibers of claim 1.

8. A carpet having pile fibers, the pile fibers of which are copolyester fibers of claim 2.

9. A carpet having pile fibers, the pile fibers of which are copolyester fibers of claim 3.

10. A carpet having pile fibers, the pile fibers of which are copolyester fibers of claim 4.

* * * * *